United States Patent [19]

Mueller

[11] 4,269,542

[45] May 26, 1981

[54] JACK-UP RIG FOR MARINE DRILLING

[75] Inventor: Sergio R. C. Mueller, Rio de Janeiro, Brazil

[73] Assignee: Petroleo Brasileiro S.A. - Petrobras, Rio de Janeiro, Brazil

[21] Appl. No.: 49,297

[22] Filed: Jun. 18, 1979

[30] Foreign Application Priority Data

Jul. 19, 1978 [BR] Brazil ..... 7804645

[51] Int. Cl.[3] ..... E02B 17/00; B63B 35/00

[52] U.S. Cl. ..... 405/196; 175/9; 405/203

[58] Field of Search ..... 405/197–200, 405/195, 196, 203–208; 175/5, 7, 9

[56] References Cited

U.S. PATENT DOCUMENTS

| | | | |
|---|---|---|---|
| 2,399,656 | 5/1946 | Armstrong | 405/200 X |
| 2,975,601 | 3/1961 | Thorson | 175/9 X |
| 3,001,595 | 9/1961 | Lucas | 175/9 |
| 3,244,242 | 4/1966 | Wolff | 175/9 |
| 3,451,493 | 6/1969 | Storm | 175/9 |
| 3,830,071 | 8/1974 | Le Tourneau | 405/197 |
| 3,872,679 | 3/1975 | Fisher | 405/200 |

*Primary Examiner*—Dennis L. Taylor

*Attorney, Agent, or Firm*—Jack Posin; Norbert P. Holler

[57] ABSTRACT

This invention relates to a mobile drilling platform of the jack-up type equipped with a special system which allows the said drilling platform to work as a drilling derrick and alternatively as a hoisting crane rig for marine service.

3 Claims, 7 Drawing Figures

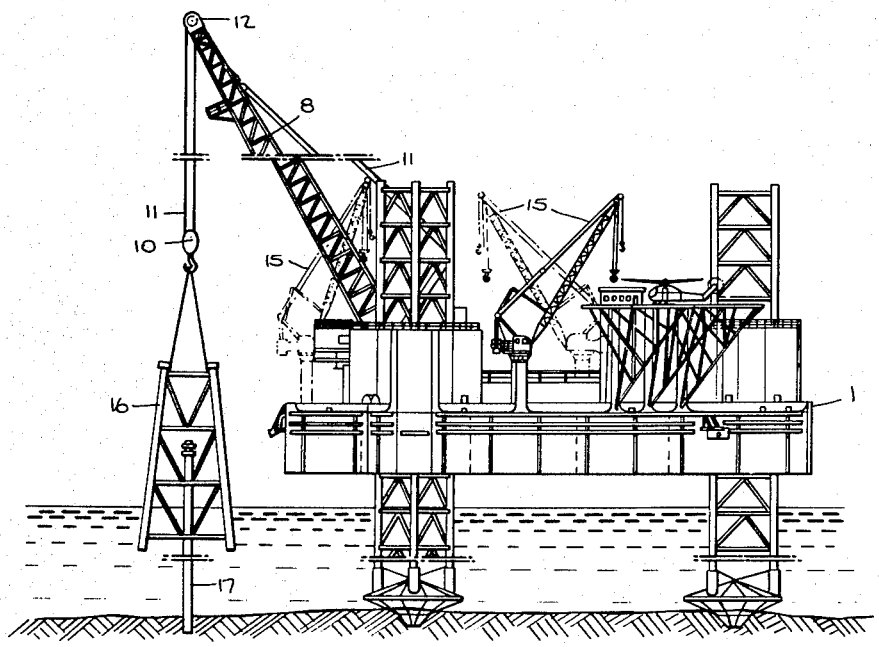

JACK-UP RIG FOR MARINE DRILLING

More specifically, the invention relates to a drilling platform convertible into a hoisting crane which, once positioned, can work without interruption, not being subject to sea pitching conditions.

Marine drilling rigs known heretofore, because they do not have a large capacity crane on their decks, require the services of a crane-barge to perform certain operations like fixing or removing their own leg sections, installing structures, etc, operations which involve shipping very heavy members or equipments from one location to another. As, when performing those operations, the crane-barge is subject to the environmental conditions, if sea pitching overcomes certain limits already determined by the practice, the service of the crane-barge has to be interrupted until the sea conditions become favorable. Such interruptions, that in certain periods of the year become more frequent due to sudden weather changes, cause great delay in the operations resulting in huge losses.

According to the techniques heretofore employed in the exploitation of undersea fields, a crane-barge is sent to the working area in order to anchor the fixed structures on which the drilling operations will be performed. Then, a floating platform bearing the equipment and other necessary means to perform the drilling work is positioned beside the cited structures already fixed to the bottom of the sea.

The most recent models of platform are those of the jack-up type which are towed with the retrieved legs raised quite above the hull of the rig. When the platform arrives at the work site, the legs are lowered again until reaching the firm ground on the bottom and, only then, the hull is lifted up to a safe height above the sea level.

The positioning of a floating rig turns out to be a critical point in the operation since it suffers strong influence from the sea pitching conditions which, in certain cases, may cause the said rig to collide with the fixed structures already installed, thus involving great risk.

Another great problem of conventional floating rigs is concerned with the design of their own legs. Usually such rigs or platforms have legs constructed in sections which may be joined one to another by means of pins or by any other means whatsoever until they reach the necessary length, in accordance to the depth of the water layer where said platform is working. For safety and stability reasons, before towing the rig from one place to another, long leg sections are removed and stored on the deck during the trip to the new job site. Those operations of piling up the legs and installing them at the new place are generally performed by a crane-barge.

As each section of the leg is from about 20 to 30 meters high and weighs up to 150 to 200 tons or more, those operations present some difficulties when performed by a crane-barge, specially if the environmental conditions are unfavorable. Furthermore, the operational costs of a hoisting barge are extremely high (approximately three to four times the operational costs of a drilling rig).

Some approaches have been made to solve the problem but with results not entirely satisfactory. For example, the device described in U.S. Pat. No. 3,830,071 intends to solve only the problems of leg movement and drilling rig stability when the platform is being towed, but the problem of fixing the platform was not approached.

One object of the present invention is to provide a floating jack-up rig having the function of a marine drilling deck and, alternately, that of a large capacity crane able to move the leg sections, to fix the protective structures on the bottom of the sea, etc.

Another object of this invention is to provide a high capacity hoisting rig able to work without interruption even under adverse sea conditions.

The rig of this invention is provided with special features which allows to convert, whenever necessary, the drilling equipment into a large crane able to move loads of the order of 200 tons or more.

At the same time, this crane does not cause overload problems nor require dimensional alterations of the structure since all its elements are components of the drilling rig. The alteration from a drilling rig to a large crane can thus be carried out in a few hours by the drilling crew itself.

The invention comprises a movable rig of the jack-up type, fitted with all conventional devices necessary for marine drilling of oil wells and is characterized by the following special features:

(a) a mast type drilling derrick attached to a movable structure on a drilling deck by means of pivots which permit it to be tilted in order to be changed into a crane boom;

(b) a drilling winch equipped with an auxiliary drum which is normally designed to perform swabbing operations but, when the equipment is working in the crane version, is employed to hold the crane boom in position or change its inclination;

(c) a drilling deck mounted on a swivelling base capable of 360° rotation in any direction, said swivelling base also forming the rotating crane table when the assembly formed by the drilling tower, the drilling hoist and the drilling deck is acting as a crane;

(d) a movable substructure over which said swivelling base rests, said movable substructure being provided with a motor which transmits rotating motion to the swivelling base, this motor being also designed to drive the substructure on rails along the deck whenever it is necessary for the operation of the crane.

This special system described in the present invention, which allows to convert a drilling derrick into a high capacity crane, shows great advantages over the devices heretofore known. Said system solves the problems of moving the legs of the platform, installation, and launching of structures in the bottom of the sea without impairing the stability of the rig because, as it does not require additional equipment than those existing parts of the drilling rig, the platform is never overloaded.

Through this new concept, a movable, highly versatile rig capable of operating on deep waters was obtained, either in the crane mode or in the drilling derrick mode. None of the drilling derricks previously known was able to carry out also the functions of a high capacity crane, either there was used a crane installed on a barge or a drilling derrick was available, mounted on a ship or on a rig. Therefore, the combination presented by this invention is unique.

It is known that a crane, for performing its functions, requires at least two winches, one for handling the load and the other for moving the crane boom. On the other hand, it is equally known that a drilling winch has, in general, two drums which actually work as two winches: one of them used as a drilling winch and the other as an auxiliary winch, normally used to perform swabbing operation, directional logging, etc.

Within the concept of the present invention, the drilling winch installed on the drilling rig deck forms, with the drilling derrick, the basic assembly of the crane. When the derrick is in its inclined position, acting in the crane mode, the main drum is used to actuate the load block while the auxiliary drum is employed to move the crane boom. As the assembly is mounted on a movable structure, there is the additional advantage that the position of the crane can be changed whenever necessary, said crane being able to reach different points of the deck.

In the purpose of better emphasizing the operating possibilities offered by the rig of this invention, we shall herein below describe the set of drawings which is part of this specification.

Other uses of the present invention may be clearly understood by those skilled in the art. For example, the crane may be used to remove sections of legs from the deck or other equipment not in use and place them on a ship which will take them to the land thus making room on the deck for better performing drilling operations.

Otherwise the system of the present invention may be adapted to small size platforms, or else, the rig of this invention may be used coupled to another type of rig.

All those alternative embodiments, while not emphasized in these specifications, shall be comprehended within the scope of this invention.

BRIEF DESCRIPTION OF THE DRAWINGS

FIG. 3 is a side elevational view of the FIG. 1 rig operating in the crane mode;

FIG. 1 shows a top view of the main deck (1) where we see some of the components of the platform. On the main deck there is a movable substructure (3) mounted on rails (2). Said substructure can be displaced on said rails from one extremity to the other of the deck driven by a motor enclosed in structure but not shown in the drawings.

Figure 1:
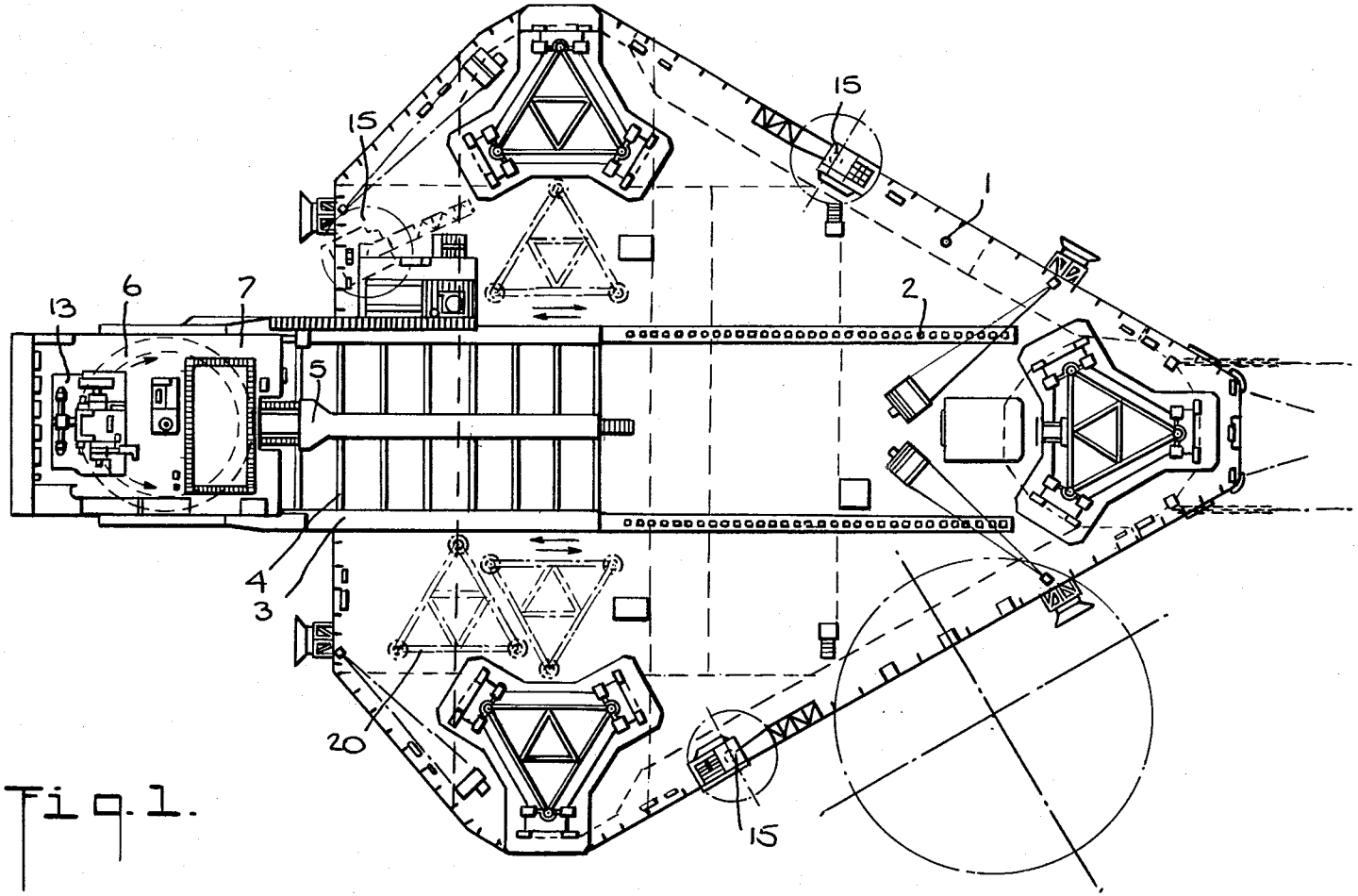
FIG. 1 is a plan view of a mobile jack-up rig constructed in accordance with the invention.
Figure 2:
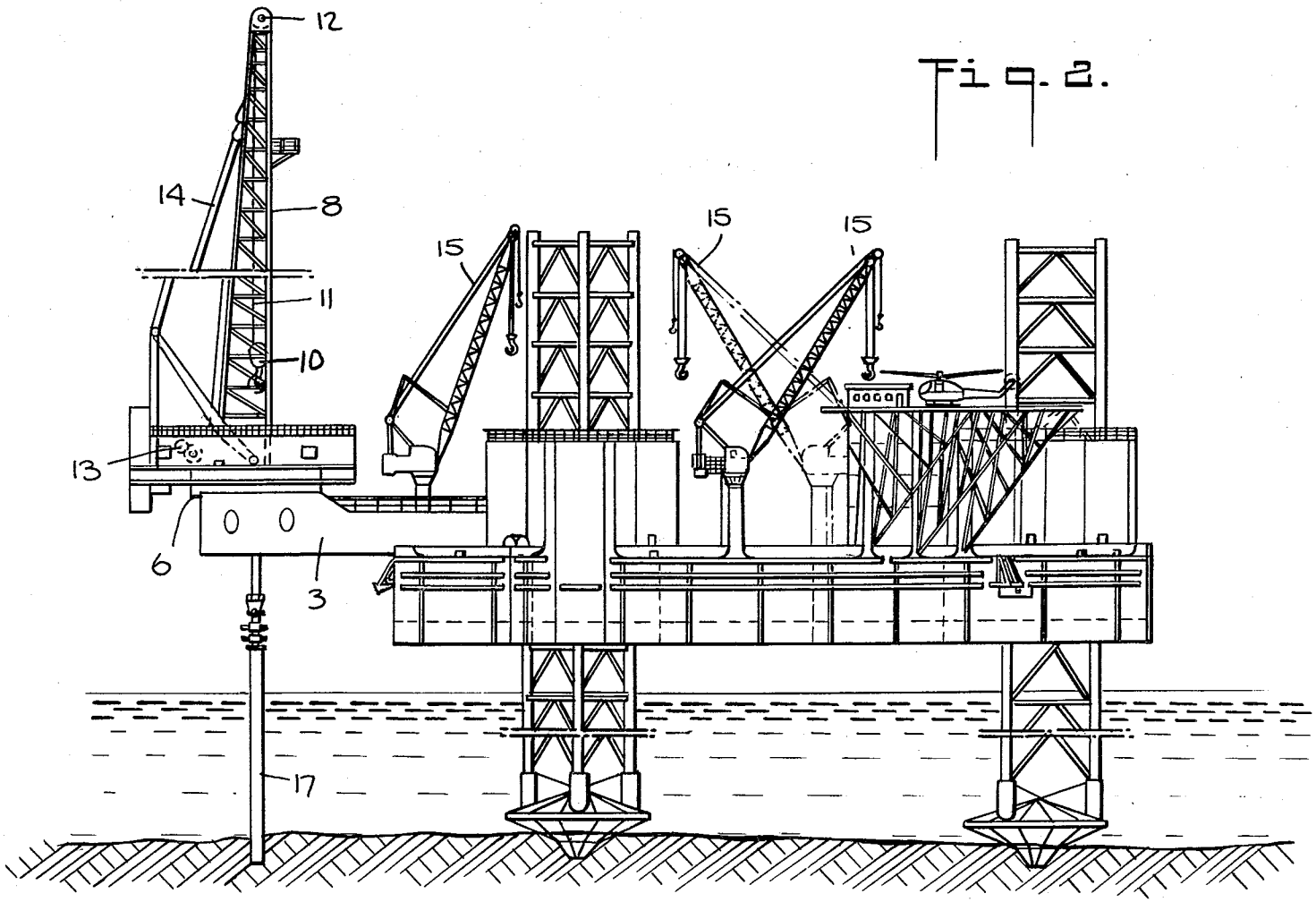
FIG. 2 is a side elevational view of the FIG. 1 rig operating in the drilling rig mode.
Figure 9:
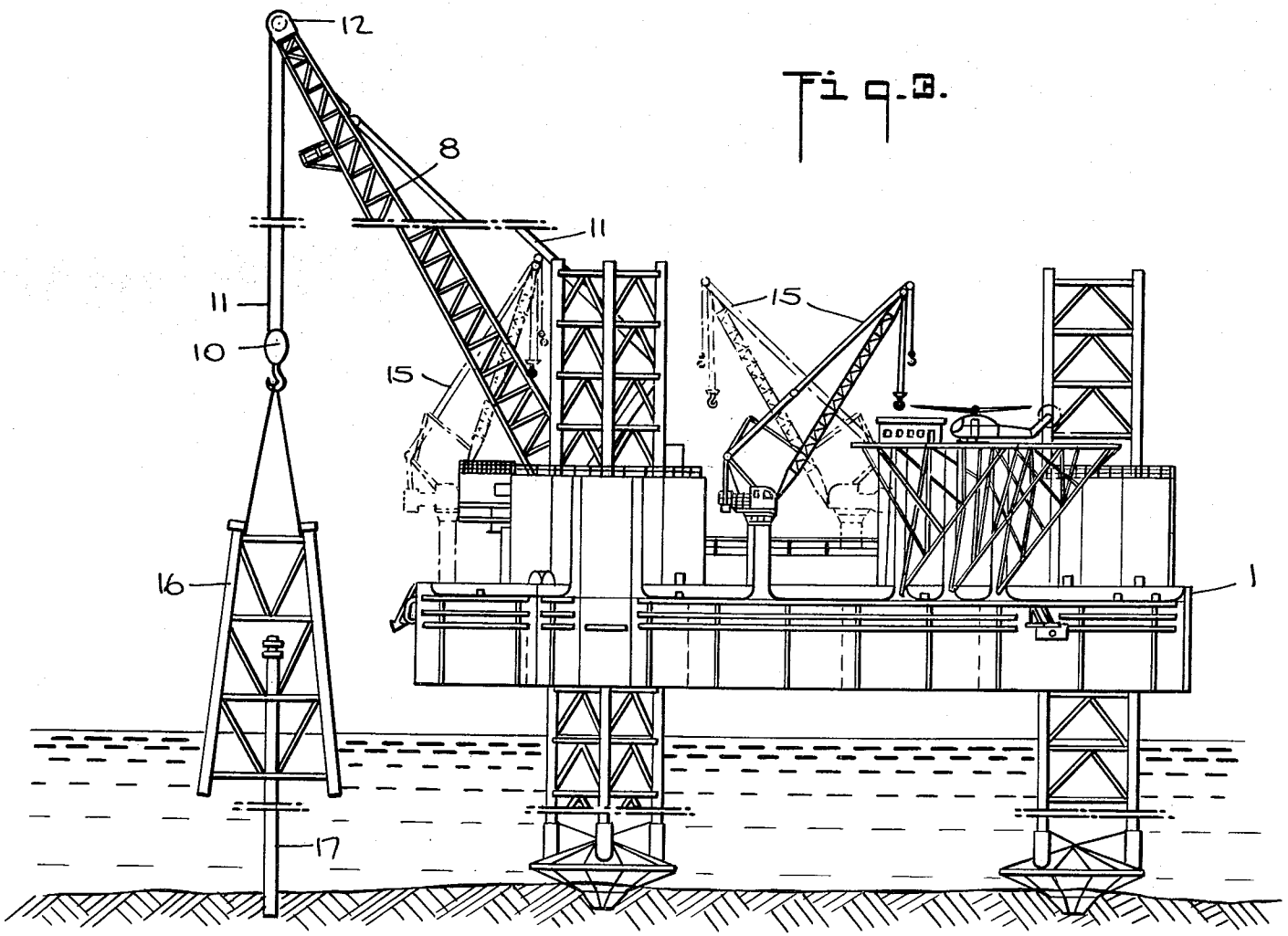

Said substructure (3) includes a pipe rack (4), a passageway (5) and supports a swiveling base (6) which is better seen in FIG. 2. On said swivelling base, the principal constituents of the drilling rig are mounted: drilling deck (7) on which the derrick (8) is mounted, articulated on said deck (7) by means of the pivots (9), and provided with the wire lines (11) and the crown block (12) necessary to actuate the travelling block (10). A drilling winch (13) is mounted on the drilling deck (7) to drive the wire lines which actuate on the moving parts of the derrick. Such drilling winch (13) is provided with two drums (not shown in detail in the drawings) acting separately; one drum actuates the wire lines (11) which moves the travelling block (10) while the other drum actuates the wire lines (14) designed primarily to drive the parts which perform swabbing operations, directional logging, movement of parts along the well, etc. The above mentioned details can be seen in FIG. 2 when the assembly is operating in the drilling rig mode.

In FIG. 3 we see the platform working in the crane mode mounting a protecting fixed structure (16), or jacket, over an exploratory well (17). The drilling derrick (8) was converted into a crane boom while one of the drums of the winch (13) works to drive separately the wire lines (11) which move the block (10) acting now as a hook to hoist heavy loads and the other drum actuates the wire lines (14) which are now employed to maintain or change the inclination of the boom during hoisting operations.

As it can be seen from FIGS. 2 and 3, when acting as a crane boom, the drilling deck (7) is rotated through the swivelling base (6) and the movable substructure (3) is displaced along the rails (2) if necessary to place the load in the correct position.

Figure 4:
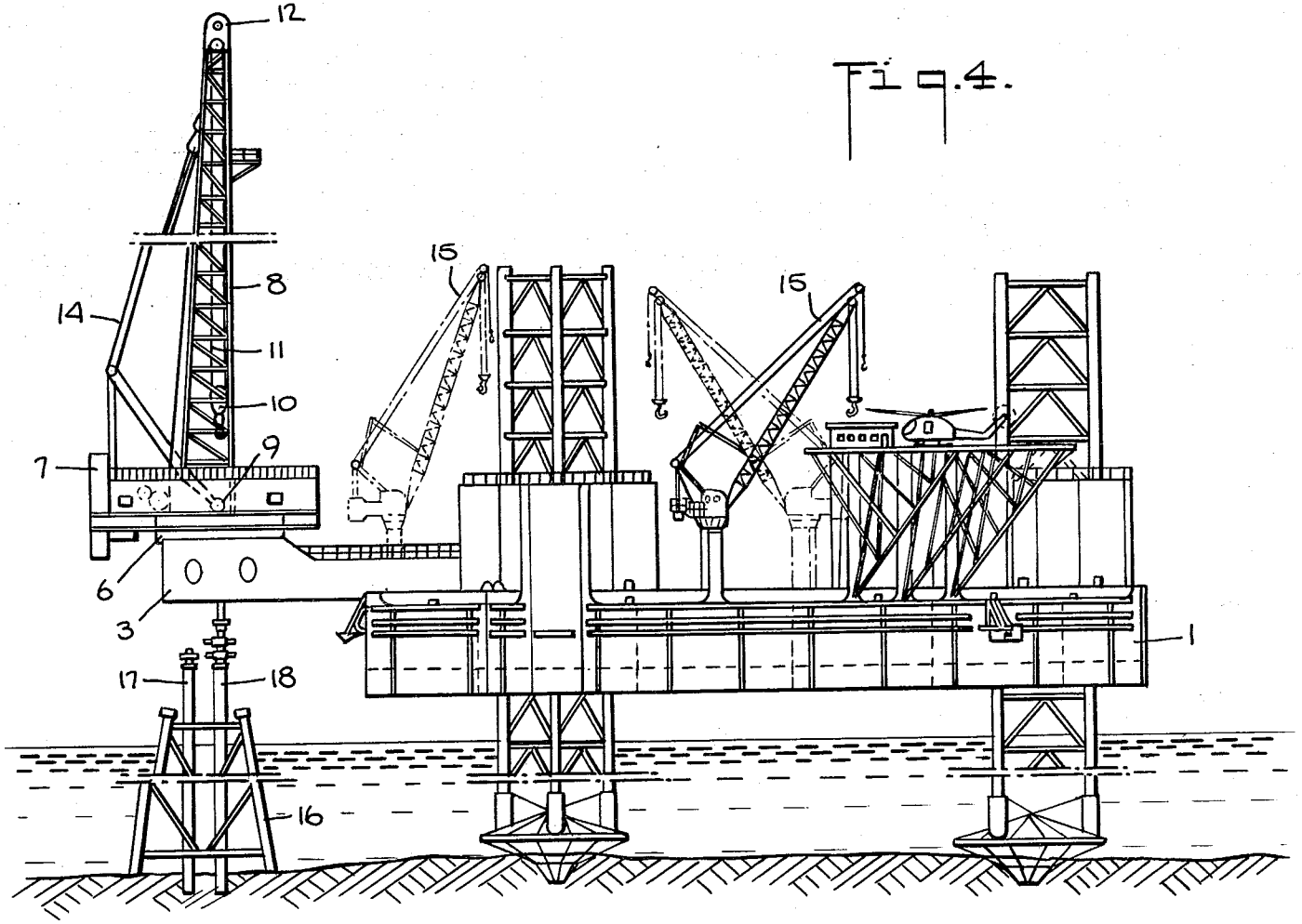
FIG. 4 is a side elevational view of the FIG. 1 rig again operating in the drilling rig mode.

FIG. 4 shows the rig working again as a drilling deck over the jacket (16) already installed, drilling the additional well (18). The movable substructure (3) can only be displaced inwardly and outwardly to the main deck of the rig (by means of a motor not shown in the figure) according to the service to be performed.

Figure 5:
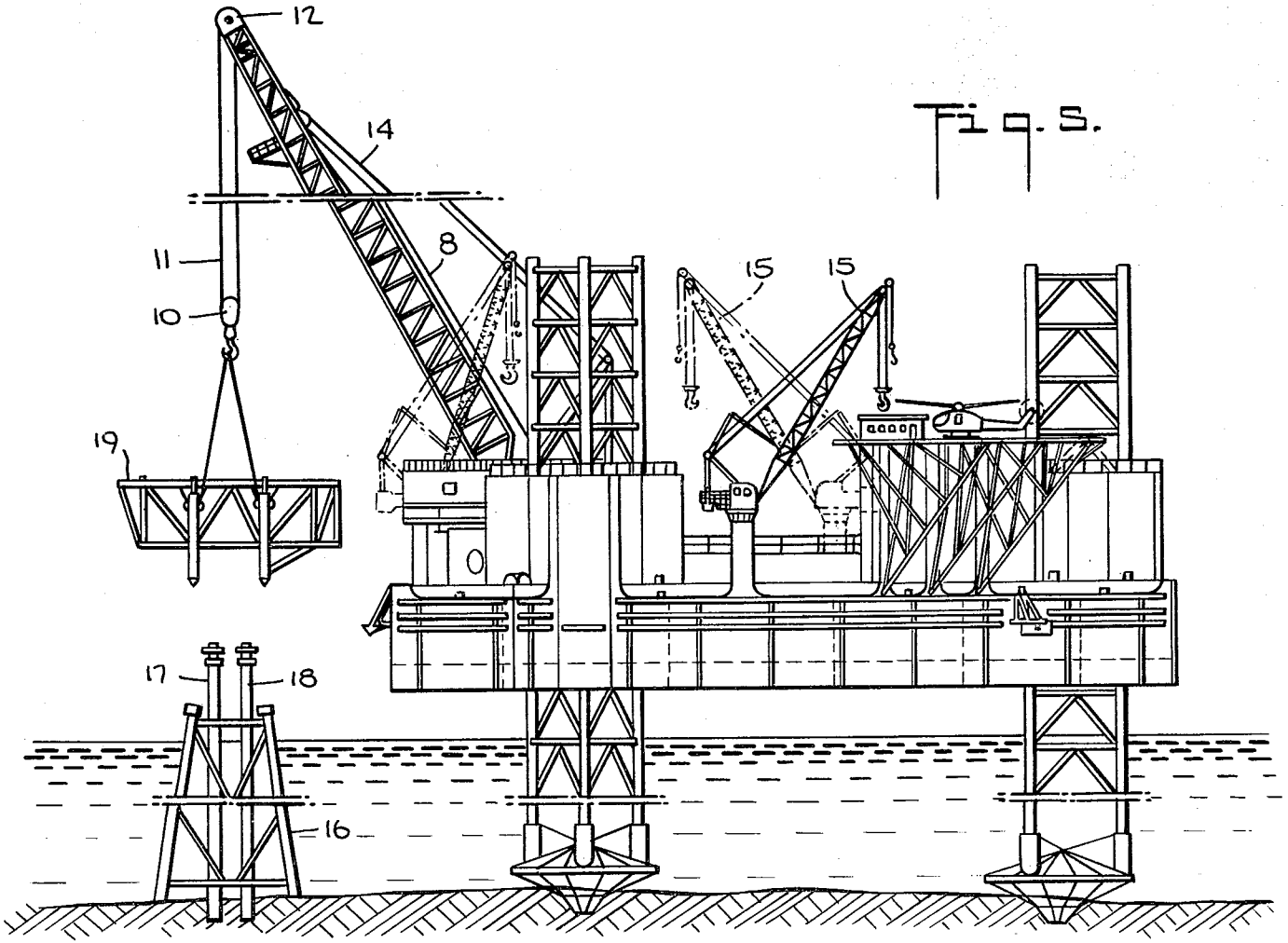
FIG. 5 is a side elevational view of the FIG. 1 rig again operating in the crane mode.

FIG. 5 shows the rig working in the crane mode. In this case the crane is being used to mount a production deck (19) on the jacket (16) which encloses the well heads (17,18). Said production deck is designed to hold the equipment used during the production stage of the wells.

Figure 6:
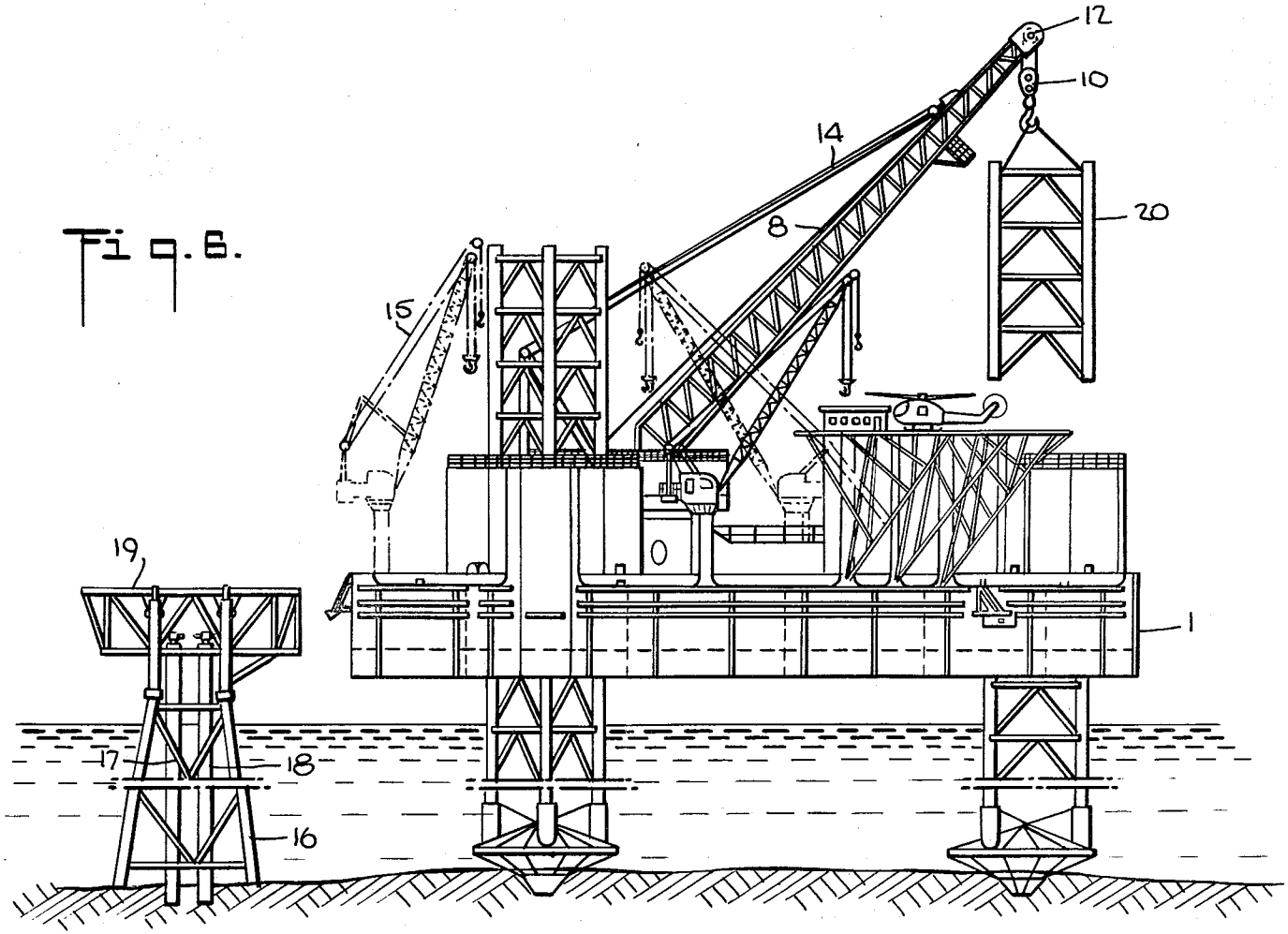
FIG. 6 is a side elevational view of the FIG. 1 rig operating in the crane mode.

FIG. 6 also shows the rig working in the crane mode. Drilling operations were already concluded; the wells (17,18) were already drilled and completed and the protection structures (16,19) installed. The crane was displaced to the central part of the main deck (1) along the rails and is now romoving the sections of legs (20), thus preparing the rig to be towed.

Figure 7:
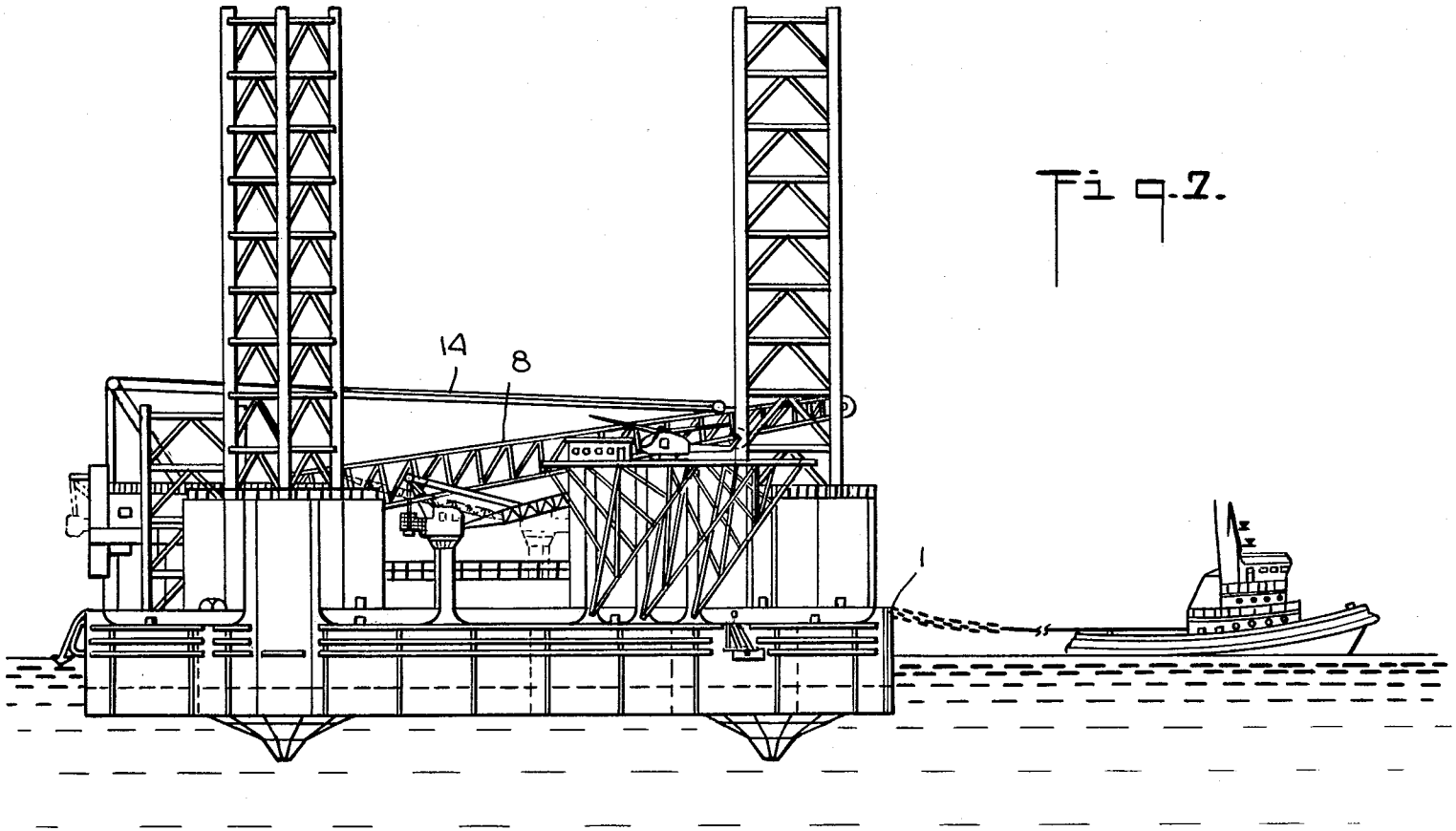
FIG. 7 is a side elevational view of the rig being towed by a boat.

FIG. 7 shows the rig being towed. The legs of platform were retrieved, the movable substructure (3) was displaced towards the center of the main deck (1) and the drilling derrick (8) is laid down on the deck in order to make the shipping easier and the assembly more stable.

As it can be seen, the platform is provided with small lateral cranes (15) to perform small jobs involving hoisting of relatively little items. It is important to note that said small cranes (15) are not able to perform the job done by the big crane in which the drilling derrick (8) can be changed. If such big crane is not available on the platform, a auxiliary crane-barge has to be employed.

I claim:

1. A mobile jack-up rig, for marine drilling, of the self-elevating type having a floatable hull, legs which can be propelled from transport positions projecting above the hull downwardly to engage the bottom of the sea to serve as bases for use in jacking-up the hull to a stable drilling position substantially above the water surface, said rig being fitted with conventional devices and equipment for marine drilling of oil wells characterized by comprising a special system which allows the conversion of a drilling derrick into a high capacity crane and vice-versa, said special system comprising the following members:

(a) a drilling derrick attached to a movable structure on a drilling deck by means of pivots which permit it to be tilted in order to be changed into a crane boom;

(b) a drilling winch provided with two drums which act separately including a main drum which actuates the wire lines that move the travelling block and a secondary drum which actuates the wire lines that move the parts which perform swabbing operations, directional logging, movement of parts along the well, etc.;

(c) a drilling deck mounted on a swivelling base capable of rotating 360° in any direction, said swivelling base also forming the rotating crane table when the assembly formed by the drilling derrick and the drilling deck is acting as a crane; and (d) a movable substructure over which said swivelling base rests, said movable substructure being provided with a motor which transmits rotating motion to the swivelling base, this motor also being designed to drive the substructure on rails along the deck whenever it is necessary for the operation of the rig in the crane mode.

2. A mobile jack-up rig for marine drilling according to claim 1 characterized in that said main drum of said drilling winch is employed to move the load block and the auxiliary drum of said drilling winch is used to move the crane boom whenever said drilling derrick is working as a crane.

3. A mobile jack-up rig or marine drilling according to claim 1 characterized in that said drilling derrick is laid down on the main deck during the transportation of the rig from one place to another.

* * * * *